US008388174B2

(12) United States Patent
Rooymans

(10) Patent No.: US 8,388,174 B2
(45) Date of Patent: Mar. 5, 2013

(54) LIGHTING ARRANGEMENT

(75) Inventor: Johannes Otto Rooymans, Ermelo (NL)

(73) Assignee: Lemnis Lighting Patent Holding B.V., Naarden (NL)

( * ) Notice: Subject to any disclaimer, the term of this patent is extended or adjusted under 35 U.S.C. 154(b) by 258 days.

(21) Appl. No.: 12/670,683

(22) PCT Filed: Jul. 23, 2008

(86) PCT No.: PCT/EP2008/059665
§ 371 (c)(1),
(2), (4) Date: Jan. 26, 2010

(87) PCT Pub. No.: WO2009/013317

PCT Pub. Date: Jan. 29, 2009

(65) Prior Publication Data

US 2010/0220471 A1 Sep. 2, 2010

(30) Foreign Application Priority Data

Jul. 26, 2007 (EP) ..... 07113195

(51) Int. Cl.
*F21V 9/00* (2006.01)

(52) U.S. Cl. ..... 362/231; 362/230; 362/293; 362/545; 362/800

(58) Field of Classification Search ..... 362/230–231, 362/293–294, 545, 800
See application file for complete search history.

(56) References Cited

U.S. PATENT DOCUMENTS

| | | | |
|---|---|---|---|
| 6,132,072 | A | 10/2000 | Turnbull et al. |
| 6,250,774 | B1 | 6/2001 | Begemann et al. |
| 2004/0105261 | A1 | 6/2004 | Ducharme et al. |
| 2004/0120152 | A1 | 6/2004 | Bolta et al. |
| 2004/0196653 | A1 | 10/2004 | Clark et al. |
| 2006/0007013 | A1 | 1/2006 | Singer et al. |
| 2007/0211463 | A1 | 9/2007 | Chevalier et al. |
| 2008/0080178 | A1 | 4/2008 | Kita et al. |

FOREIGN PATENT DOCUMENTS

| | | | |
|---|---|---|---|
| CN | 1945104 | A | 4/2007 |
| EP | 1557604 | A | 7/2005 |
| GB | 540053 | A | 10/1941 |
| GB | 559646 | A | 2/1944 |
| JP | 2006277979 | A | 10/2006 |
| JP | 2007165051 | A | 6/2007 |
| WO | 2006132533 | A | 12/2006 |
| WO | 2007100837 | A2 | 9/2007 |

OTHER PUBLICATIONS

Transportation Lighting Alliance Report: Spectral Effects of Led Forward Lighting, J. Van Derlofske et al, p. 9, Apr. 2005.
Internet publication: New Discoveries in vision affect lighting practice, S.M. Berman, Apr. 2007.

*Primary Examiner* — Meghan Dunwiddie
(74) *Attorney, Agent, or Firm* — David P. Owen; Coraline J. Haitjema; Hoyng Monegier LLP

(57) ABSTRACT

The invention relates to a lighting arrangement (1) for illuminating an area under mesopic conditions. The lighting arrangement has one or more LEDs (6) emitting substantially monochromatic light in a first wavelength region. The lighting arrangement further has one or more LEDs emitting (8) substantially-monochromatic light in a second wavelength region. Aforementioned combination of LEDs is such that, in use, the light provided by the lighting arrangement has an S/P-ratio greater than 2.

6 Claims, 5 Drawing Sheets

LIGHTING ARRANGEMENT

BACKGROUND OF THE INVENTION

1. Field of the Invention

The invention relates to a lighting arrangement for illuminating an area under mesopic conditions.

2. Description of the Related Art

Lighting for illumination of an area under mesopic conditions like utility lighting, e.g. street lighting, lighting used to illuminate parks, car parkings, gardens, and emergency lighting, as currently widely used, is designed to illuminate the relevant area in a way that provides an agreeable aura. Conventional light sources for utility lighting include incandescent, fluorescent and other discharge lamps.

Recently, alternative low-energy designs have been developed using LED source which are of considerably higher luminance, i.e. significantly more concentrated in terms of flux/mm$^2$. This development has been focused on LEDs which generate white light. The white light is then formed by arranging interaction between light emitted by blue LEDs and a suitable phosphor.

Both conventional lamps and white LEDs based on blue LEDs combined with phosphors are not optimally designed with respect to the human eye at reduced light levels, i.e. under so-called mesopic light conditions.

The human eye has two types of photoreceptors. The first type of photoreceptors, called cones, is used for daytime vision. The second type of photoreceptors, called rods, is used for vision at reduced light levels together with the cones. The light level during daytime is generally such that cones suppress the rods. Hence, only the cones are used. However, the dominance of the cones diminishes if the light level is reduced. The rods become more dominant under the latter condition.

In international patent application WO2006/132533, a lighting arrangement is described which provides an improved visibility compared with conventional utility lighting. The lighting arrangement is designed to emit light in a first wavelength region and light in a second wavelength region. The lighting unit is further designed to generate light having a dominant wavelength from the first wavelength region in such a way that the eye sensitivity of the human eye is dominated by rods. Although, the lighting arrangement described in WO2006/132533, can improve vision at low intensity, further improvement is desired.

SUMMARY OF THE INVENTION

It is an object of the invention to provide a lighting arrangement for illuminating an area which provides an improved visibility, especially under mesopic light conditions.

For this purpose, an embodiment of the invention provides a lighting arrangement for illuminating an area under mesopic conditions comprising:

- one or more LEDs emitting substantially monochromatic light in a first wavelength region;
- one or more LEDs emitting substantially monochromatic light in a second wavelength region;

such that, in use, the light provided by the lighting arrangement has an S/P-ratio greater than 2.0. It has been found that, under mesopic light conditions, the perception of a peripheral field of view upon illumination by embodiments of the lighting arrangement as proposed is about twice the perception of the peripheral field of experienced upon illumination by means of a conventional lamp having an S/P-ratio of 1.5, if the S/P-ratio of the lighting arrangement is greater than 2.0.

In further embodiments of the invention, the lighting arrangement may have an S/P-ratio greater than 2.3 or greater than 2.5. With such embodiments, further enhancement of peripheral view may be achieved.

In an embodiment, the first wavelength region has a range of 500-525 nm, and the second wavelength region has a range of 600-625 nm. With such an embodiment, aforementioned doubling of perception in the peripheral field of view may be obtained.

In another embodiment, the first wavelength region has a range of 500-525 nm, and the second wavelength region has a range of 600-640 nm. With such an embodiment, aforementioned further improvement of the peripheral field of view may be obtained.

In an embodiment, in use, emitted light in the first wavelength region in combination with emitted light in the second wavelength region results in light with chromaticity x-coordinates between 0.290 and 0.330, and with chromaticity y-coordinates between 0.550 and 0.590.

In another embodiment, in use, emitted light in the first wavelength region in combination with emitted light in the second wavelength region results in light with chromaticity x-coordinates between 0.385 and 0.425, and with chromaticity y-coordinates between 0.490 and 0.530.

In an embodiment, in use, a ratio of the light intensity of the emitted light in the first wavelength region with respect to the light intensity of the emitted light in the second wavelength region equals 3:2.

In another embodiment, in use, a light intensity of the emitted light in the first wavelength region equals a light intensity of the emitted light in the second wavelength region.

In embodiments of the invention, the S/P-ratio may be smaller than 3.7. Light emitted by a lighting arrangement with an S/P-ratio smaller than 3.7 is generally considered to be sufficiently agreeable for several applications.

In embodiments of the invention, the lighting arrangement further comprises one or more LEDs emitting substantially monochromatic light in a third wavelength region. The third wavelength region may have a range of 460-490 nm. In further embodiments, in use, emitted light in the first wavelength region in combination with emitted light in the second wavelength region and emitted light in the third wavelength region results in light with chromaticity x-coordinates between 0.220 and 0.260, and with chromaticity y-coordinates between 0.300 and 0.340.

BRIEF DESCRIPTION OF THE DRAWINGS

Further features and advantages of the invention will be appreciated upon reference to the following drawings, in which.

DESCRIPTION

The following is a description of a number of embodiments of the invention, given by way of example only and with reference to the drawings.

Figure 1:
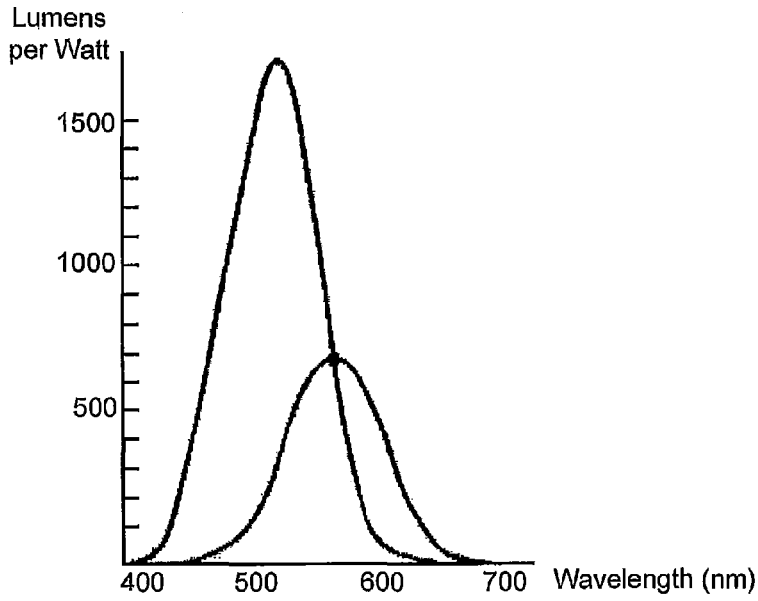
FIG. 1 schematically shows curves representing a spectral luminous efficacy for human vision.

FIG. 1 schematically shows curves representing the spectral luminous efficacy for human vision. The left curve is referred to as the scotopic vision curve. The right curve is referred to as the photopic vision curve.

Photopic vision may be defined as the vision of the human eye under well-lit conditions. In photopic vision, the cones of the human eye are used.

The photopic vision curve is a result of extensive testing, and shows the sensitivity of the human eye for a "standard observer" under well-lit conditions as a function of wavelength. At each wavelength, a relative value for the standard observer's sensitivity is assigned, i.e. a luminous efficacy at that wavelength, $V(\lambda)$. The maximum efficacy of photopic vision is 683 lumen/W at a wavelength of 555 nm. The value of $V(\lambda)$ is designated as unity at 555 nm, and decreases to zero at the ends of the visible spectrum.

Scotopic vision may be defined as the monochromatic vision of the human eye under low-lit conditions. Scotopic vision is dominated by the rods in the human eye.

The scotopic vision curve is also a result of extensive testing, and shows the sensitivity of the human eye for a standard observer under low-lit conditions as a function of wavelength. Again, at each wavelength, a relative value for the standard observer's sensitivity is assigned, referred to as luminous efficacy $V'(\lambda)$. The value of $V'(\lambda)$ is designated as unity at 507, and decreases in a similar fashion as the photopic vision curve.

The unit "lumen" used throughout the technical field of lighting is defined such that, by adjustment of the peak value of the scotopic vision curve, the photopic vision curve and scotopic vision curve cross each have the same luminous efficacy of 683 lumen/W at 555 nm, as is schematically shown in FIG. 1.

Embodiments of the invention are in particular suitable for use under mesopic conditions. Mesopic vision relates to a combination of photopic vision and scotopic vision in intermediate lighting conditions, i.e. conditions with a luminance level of 0.01-3 cd/m$^2$. The expression "Cd" stands for candela, defined as the luminous intensity, in a given direction, of a source that emits monochromatic radiation of a frequency of 540 THz and that has a radiant intensity in that direction of $1/683$ watt per steradian.

Throughout this description, the expression S/P-ratio will be used. The S/P-ratio refers to the ratio between scotopic efficacy $V'(\lambda)$ and photopic efficacy $V(\lambda)$.

Figure 2A:
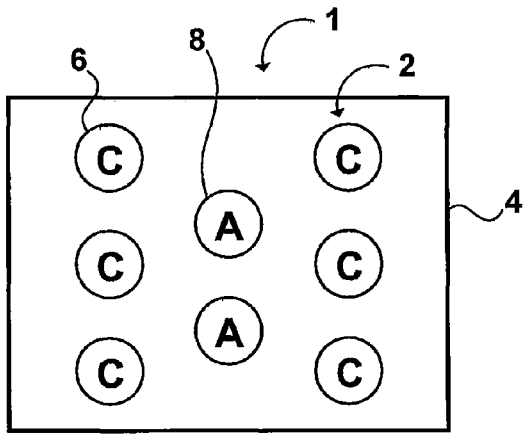
FIG. 2A schematically shows a plan view of a first embodiment of an lighting arrangement according to the invention.

FIG. 2A schematically shows a plan view of a first embodiment of an lighting arrangement according to the invention. The lighting arrangement comprises an array 1 of light emitting diodes 2 mounted on a common substrate 4. The array 1 comprises six cyan/green colored LEDs 6 and two amber/red colored LEDs 8.

Figure 2B:
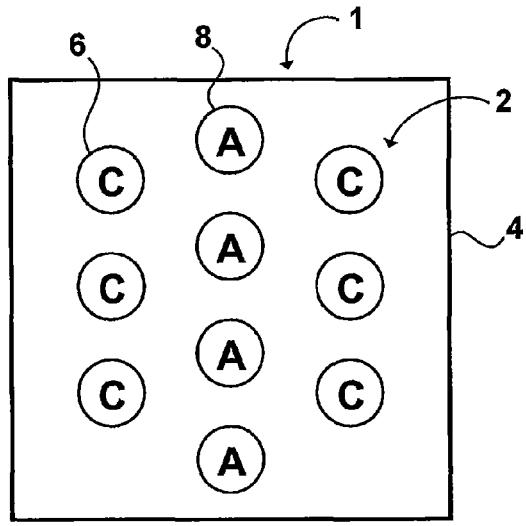
FIG. 2B schematically shows a plan view of a second embodiment of an lighting arrangement according to the invention.

FIG. 2B schematically shows a plan view of a second embodiment of an lighting arrangement according to the invention. The lighting arrangement again comprises an array 1 of light emitting diodes 2 mounted on a common substrate 4. The array 1 comprises six cyan/green colored LEDs 6 and four amber/red colored LEDs 8.

The LEDs 6, 8 are otherwise conventional and emit substantially monochromatic light in a first and second wavelength region respectively. Suitable selection of wavelengths for respective LEDs 6, 8 may be such that light provided by an lighting arrangement comprising the array shown in FIGS. 2A and 2B has an S/P-ratio greater than 2, as will be discussed in more detail with reference to FIG. 4.

Figure 3:
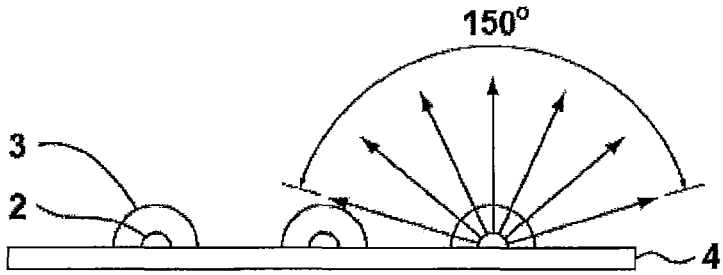
FIG. 3 schematically shows a side elevation view of lighting arrangements as shown in FIGS. 2A and 2B.

FIG. 3 schematically shows a side elevation view of lighting arrangements as shown in FIGS. 2A and 2B. As shown in FIG. 2, the LEDs 2 may each be covered by an encapsulation 3 of epoxy resin material. Each encapsulation 3 may be substantially hemispherical such that light is emitted in a planar distribution pattern perpendicular to its surface and no significant refraction or focusing of the light takes place. The emitted light then produces a generally uniform conical pattern having a solid angle, e.g. of around 150°. Although not shown, it is understood that a common encapsulation of all of the LEDs 2 could also be used.

Figure 4:
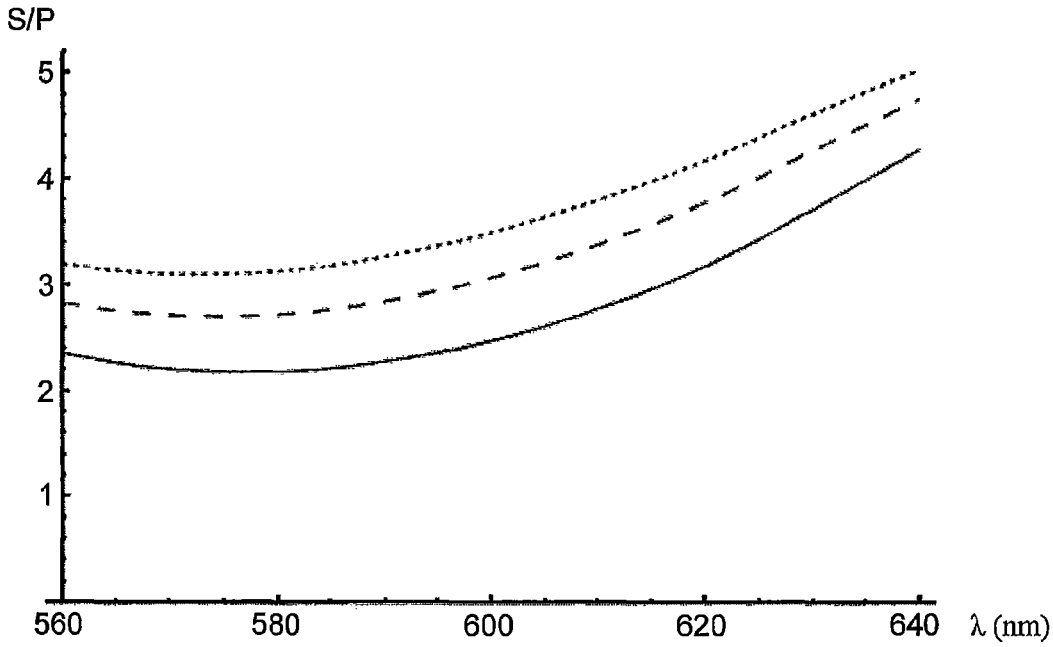
FIG. 4 depicts a graph of S/P-ratio as a function of wavelength for the lighting arrangements schematically shown in FIGS. 2A and 2B.

FIG. 4 depicts a graph of S/P-ratio as a function of wavelength for a lighting arrangement comprising one or more LEDs emitting monochromatic light with a wavelength of 507 nm, further referred to as green/cyan LEDs, and one or more LEDs emitting light in aforementioned second wavelength region, further referred to as amber/red LEDs. The graph further shows how the S/P-ratio of the lighting arrangement depends on the wavelength of the amber/red LEDs for different ratios between the light intensity emitted by cyan/green LEDs and the light intensity of light emitted by red/amber LEDs. It must be understood that a similar dependence of S/P-ratio on wavelength of light emitted by the amber/red LEDs may be drawn for wavelengths of the green/cyan LEDs different from 507 nm, i.e. a wavelength located in the first wavelength region which will be discussed in more detail below.

The graph in FIG. 4 depicts three different light intensity ratios. The dotted line corresponds to a lighting arrangement in which the ratio between the intensity of light emitted by the green/cyan LEDs and the intensity of light emitted by the amber/red LEDs equals 3:1. In case the intensity per LED is equal for aforementioned green/cyan LEDs and amber/red LEDs, the lighting arrangement may correspond to an array of LEDs as schematically shown in FIG. 2A.

The dashed line corresponds to a lighting arrangement in which the ratio between the intensity of light emitted by the green/cyan LEDs and the intensity of light emitted by the amber/red LEDs equals 3:2. In case the intensity per LED is equal for aforementioned green/cyan LEDs and amber/red LEDs, the lighting arrangement may correspond to an array of LEDs as schematically shown in FIG. 2B.

Finally, the solid line corresponds to a lighting arrangement in which the ratio between the intensity of light emitted by the green/cyan LEDs and the intensity of light emitted by the amber/red LEDs equals 1:1. In case the intensity per LED is equal for aforementioned green/cyan LEDs and amber/red LEDs, the lighting arrangement corresponds to an array of LEDs with an equal number of cyan/green LEDs and amber/red LEDs.

As can be deduced from the graph shown in FIG. 4, the S/P-ratio of a lighting arrangement according to an embodiment of the invention increases when the substantially monochromatic wavelength of the amber/red LED(s) increase(s). Furthermore, a greater S/P-ratio is obtained if the light intensity of light emitted by the cyan/green LEDs as compared to the light intensity of light emitted by the amber/red LEDs increases.

Furthermore, the relationship schematically depicted in the graph of FIG. 4 illustrates that it is possible to design a lighting arrangement with a predetermined S/P-ratio in a flexible manner. Careful selection of the wavelength of the amber/red LED(s) and ratio between the radiated power or light intensity of the cyan/green LEDs and the radiated power or light intensity of the amber/red LEDs suffices to develop a lighting arrangement with a predetermined, desirable S/P-ratio.

It has been found that, under mesopic light conditions, the perception of a peripheral field of view upon illumination by embodiments of the lighting arrangement as proposed is about twice the perception of the peripheral field of experienced upon illumination by means of a conventional lamps like metalhalide or halogen having an S/P-ratio of 1.5, if the S/P-ratio of the lighting arrangement is greater than 2.0. In an embodiment, aforementioned doubling of perception in the peripheral field of view may be obtained by selecting a wavelength range of 500-525 nm for the cyan/green LEDs and a wavelength range of 560-625 nm for the amber/red LEDs respectively.

Further enhancement of peripheral view may be achieved if the wavelength selected for the one or more amber/red LEDs is increased. For this purpose, embodiments of the lighting arrangement according to the invention are designed to have an S/P-ratio greater than 2.3 or, even greater than 2.5. In an embodiment, aforementioned further improvement of the peripheral field of view is obtained by selecting a wavelength range of 500-525 nm for the cyan/green LEDs and a wavelength range of 600-640 nm for the amber/red LEDs respectively.

Preferably, besides being optimized with respect to a human's eye under dimmed lighting circumstances, i.e. mesopic conditions, the lighting arrangement for illumination of spaces like gardens, parkings, streets and cellars is arranged to emit light which is agreeable. Elevation of the S/P-factor of the lighting arrangement according to embodiments of the invention above a certain value may result in a situation in which a person, being exposed to the light emitted by the lighting arrangement, will feel uncomfortable. Furthermore, at high S/P-ratios, contrast perception will decrease as well It has been found that embodiments of the invention having an S/P-ratio smaller than 3.7 obtain an improved vision under mesopic conditions while keeping a sufficient sensitivity for contrast. Furthermore, light emitted by a lighting arrangement with an S/P-ratio smaller than 3.7 is generally considered to be sufficiently agreeable for several applications.

Figure 5:
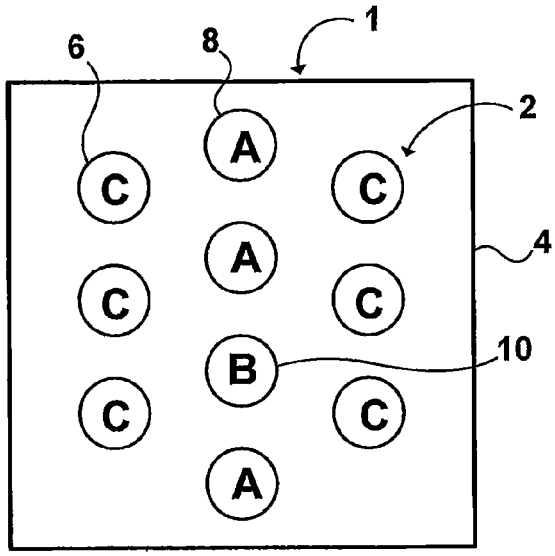
FIG. 5 schematically shows a plan view of a third embodiment of an lighting arrangement according to the invention.

FIG. 5 schematically shows a plan view of a third embodiment of an lighting arrangement according to the invention. The lighting arrangement comprises an array of light emitting diodes 2 mounted on a common substrate 4. the array 1 comprises three types of LEDs. Besides the cyan/green colored LEDs 6, six in this embodiment, and the amber/red colored LEDs 8, three in the embodiment shown, the array 1 further comprises a blue LED 10.

The blue LED 10 emits substantially monochromatic light in a third wavelength region. The third wavelength region may have a range of 460-490 nm. The addition of the blue LED 10 has an influence on the S/P-ratio and the so-called color rendering index (CRI) of the lighting arrangement, which will be discussed in more detail with respect to FIG. 6 and FIG. 7 respectively.

Figure 6:
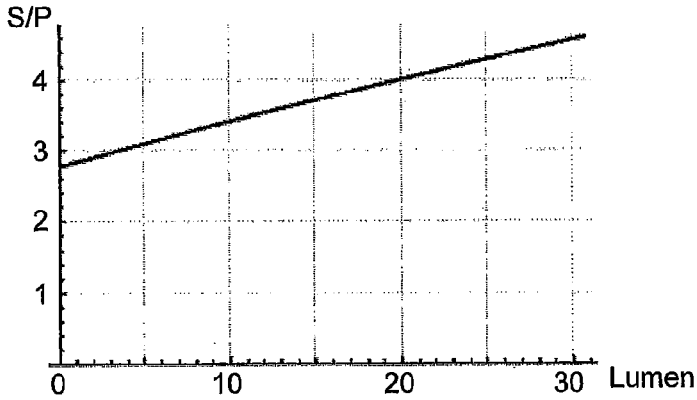
FIG. 6 depicts a graph of S/P-ratio as a function of lumen generated by part of the lighting arrangement schematically shown in FIG. 5.

FIG. 6 depicts a graph of S/P-ratio as a function of lumen generated by part of the lighting arrangement schematically shown in FIG. 5. More particularly, the graph of FIG. 6 shows the S/P-ratio as a function of lumens generated by the blue LED. It can be readily seen that adding lumens from the blue LED, e.g. substantially monochromatic light in a range from 460-490 nm, increases the S/P-ratio of the lighting arrangement.

Figure 7:
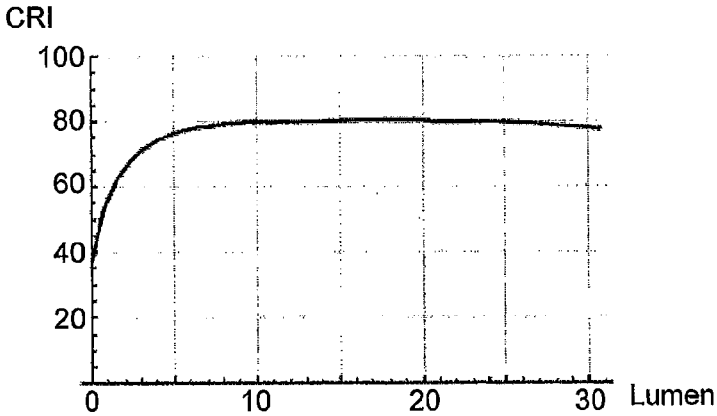
FIG. 7 depicts a graph of color rendering index as a function of lumen generated by part of the lighting arrangement shown in FIG. 5.

FIG. 7 depicts a graph of CRI as a function of lumen generated by part of the lighting arrangement shown in FIG. 5, i.e. the blue LED located therein. The CRI is a numerical indication of a lamp's ability to render individual colors accurately. It is established by comparison of a standard spectral distribution to the spectral distribution of the lamp. In this case, the standard spectral distribution taken to determine the CRI is the spectral distribution present in daytime sky light. It can be readily seen that adding lumens from the blue LED, e.g. substantially monochromatic light in a range from 460-490 nm, increases the CRI of the lighting arrangement.

Figure 8:
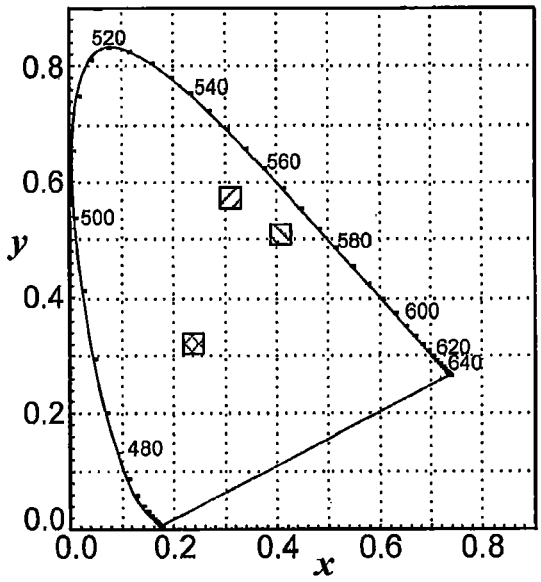
FIG. 8 shows a CIE 1931 color space chromaticity diagram.

FIG. 8 shows a CIE 1931 color space chromaticity diagram. The outer curved boundary is the so-called spectral locus, with wavelengths shown in nanometers. Experiments have shown that embodiments of the invention are especially suitable for producing light with a color corresponding to certain areas within the CIE 1931 color space chromaticity diagram.

A first area, denoted by the hatched area with lines running from the lower left to upper right relates to a lighting arrangement, wherein, in use, emitted light in the first wavelength region in combination with emitted light in the second wavelength region results in light with chromaticity x-coordinates between 0.290 and 0.330, and with chromaticity y-coordinates between 0.550 and 0.590. This light is greenish in color and provides optimal night vision in environments without any reference lamps. The adaptation of the eye will result in a perception of white light.

A second area, denoted by the hatched area with lines running from the lower right to the upper left relates to a lighting arrangement, wherein, in use, emitted light in the first wavelength region in combination with emitted light in the second wavelength region results in light with chromaticity x-coordinates between 0.385 and 0.425, and with chromaticity y-coordinates between 0.490 and 0.530.

This light is green-yellow of color with good night vision and is perceived as having a warm white color. The tint fits better in areas with other lamps.

Finally, a third area, denoted by the cross-hatched area, relates to a lighting arrangement, wherein, in use, emitted light in the first wavelength region in combination with emitted light in the second wavelength region and emitted light in the third wavelength region results in light with chromaticity x-coordinates between 0.220 and 0.260, and with chromaticity y-coordinates between 0.300 and 0.340. This color gets close to moonlight and is perceived as bluish white.

Figure 9:
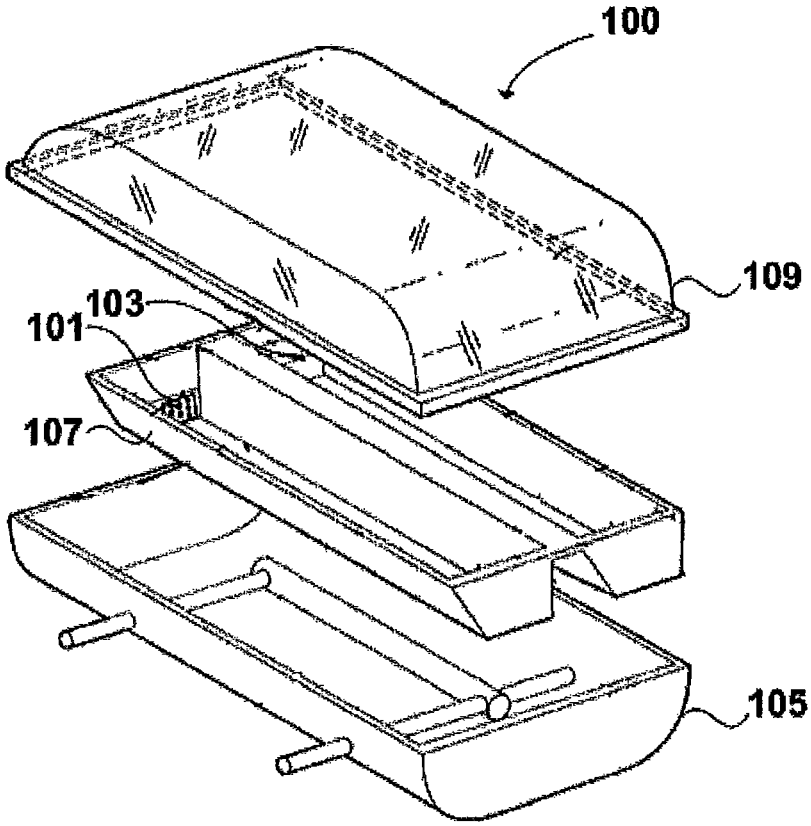
FIG. 9 schematically shows a first type of housing suitable for accommodating embodiments of the invention.

FIG. 9 schematically shows a first type of lighting unit 100 suitable for accommodating embodiments of the invention. In this unit 100, a pair of LED-arrays 101 (only one of them being visible), e.g. LED-arrays as shown in FIGS. 2A and 2B, have been mounted opposite to a pair of reflector arrangements 103 (only one of them visible) in a housing 105. Furthermore, the housing 105 may have reflective lateral surfaces 107. The LED-arrays 101 may be mounted on a heat sink to ensure that heat generated by the LEDs is removed accurately.

Furthermore, the unit 100 comprises a cap 109 for covering the lighting arrangement, i.e. LED-arrays 101 and the housing 105. The housing 105 in combination with the cap 109 forms an effectively sealed unit. A lighting unit 100 as shown in FIG. 9 is designed to be situated at one side of a street or path and reflective angled lateral surfaces 107 allow the light to be cast sideways across the width of the street.

Figure 10:
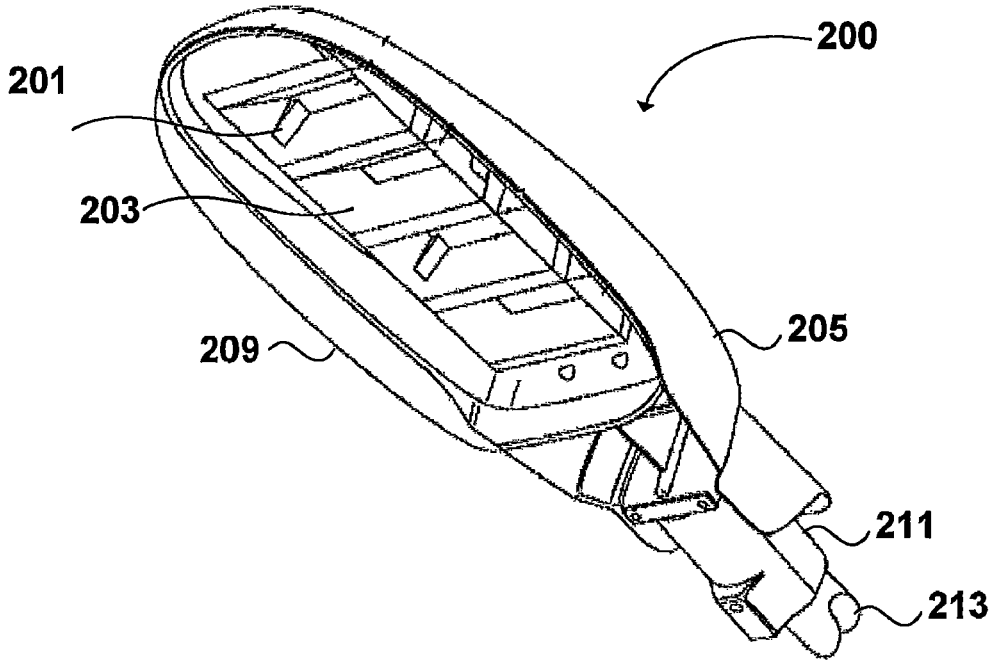
FIG. 10 schematically shows a second type of housing suitable for accommodating embodiments of the invention.

FIG. 10 schematically shows a second type of lighting unit 200 suitable for accommodating embodiments of the invention. In this unit 200, a number of LED-arrays 201, e.g. LED-arrays as shown in FIGS. 2A and 2B, have been mounted opposite to a number of reflector arrangements 203 in a housing 205. The LED-arrays 201 may again be mounted on a heat sink to ensure that heat generated by the LEDs is removed accurately.

Furthermore, the unit 200 comprises a cap 209 for covering the lighting arrangement, i.e. LED-arrays 201 and the housing 205. The housing 205 in combination with the cap 209 forms an effectively sealed unit. Bracket 211 allows for connection of the unit 200 to an external support or lamppost 213.

In aforementioned description, reference has been made to substantially monochromatic light in a second wavelength region. The expression "substantially monochromatic light" must be understood to refer to a peak wavelength of the light emitted. Hence, the peak wavelength of aforementioned substantially monochromatic light lies in a certain wavelength region.

The invention has been described by reference to certain embodiments discussed above. It will be recognized that these embodiments are susceptible to various modifications and alternative forms well known to those of skill in the art.

The invention claimed is:

1. Lighting arrangement for illuminating an area under mesopic conditions comprising:

one or more LEDs emitting substantially monochromatic light in a first wavelength region;

one or more LEDs emitting substantially monochromatic light in a second wavelength region;

such that, in use, the light provided by the lighting arrangement has an S/P-ratio greater than 2, wherein the S/P-ratio refers to the ratio between scotopic efficacy V'(λ) and photopic efficacy V(λ), and wherein emitted light in the first wavelength region in combination with emitted light in the second wavelength region results in light with chromaticity x-coordinates in the CIE 1931 color space chromaticity diagram between 0.290 and 0.330, and with chromaticity y-coordinates in the CIE 1931 color space chromaticity diagram between 0.550 and 0.590.

2. The lighting arrangement according to claim 1, wherein the SIP-ratio is smaller than 3.7.

3. Lighting arrangement for illuminating an area under mesopic conditions comprising:

one or more LEDs emitting substantially monochromatic light in a first wavelength region;

one or more LEDs emitting substantially monochromatic light in a second wavelength region;

such that, in use, the light provided by the lighting arrangement has an S/P-ratio greater than 2, wherein the S/P-ratio refers to the ratio between scotopic efficacy V'(λ) and photopic efficacy V(λ), and wherein emitted light in the first wavelength region in combination with emitted light in the second wavelength region results in light with chromaticity x-coordinates in the CIE 1931 color space chromaticity diagram between 0.385 and 0.425, and with chromaticity y-coordinates in the CIE 1931 color space chromaticity diagram between 0.490 and 0.530.

4. The lighting arrangement according to claim 3, wherein the S/P-ratio is smaller than 3.7.

5. Lighting arrangement for illuminating an area under mesopic conditions comprising:

one or more LEDs emitting substantially monochromatic light in a first wavelength region;

one or more LEDs emitting substantially monochromatic light in a second wavelength region;

one or more LEDs emitting substantially monochromatic light in a third wavelength region;

such that, in use, the light provided by the lighting arrangement has an S/P-ratio greater than 2, wherein the S/P-ratio refers to the ratio between scotopic efficacy V'(λ) and photopic efficacy V(λ), and wherein emitted light in the first wavelength region in combination with emitted light in the second wavelength region and emitted light in the third wavelength region results in light with chromaticity x-coordinates in the CIE 1931 color space chromaticity diagram between 0.220 and 0.260, and with chromaticity y-coordinates in the CIE 1931 color space chromaticity diagram between 0.300 and 0.340.

6. The lighting arrangement according to claim 5, wherein the third wavelength region has a range of 460-490 nm.

* * * * *